United States Patent [19]

Bouck et al.

[11] Patent Number: 4,463,988

[45] Date of Patent: Aug. 7, 1984

[54] HORIZONTAL HEATED PLANE PROCESS

[75] Inventors: Larry S. Bouck; Erhan Ozey; Richard E. Worsham, all of Tulsa, Okla.

[73] Assignee: Cities Service Co., Tulsa, Okla.

[21] Appl. No.: 415,206

[22] Filed: Sep. 7, 1982

[51] Int. Cl.[3] ..... E21B 43/26; E21C 41/10

[52] U.S. Cl. ..... 299/2; 299/19; 166/50; 166/272

[58] Field of Search ..... 299/2, 18, 19; 166/50, 166/303, 272

[56] References Cited

U.S. PATENT DOCUMENTS

| | | | |
|---|---|---|---|
| 4,067,391 | 1/1978 | Dewell | 166/303 |
| 4,085,803 | 4/1978 | Butler | 166/303 |
| 4,099,570 | 7/1978 | Vandergrift | 166/303 |
| 4,201,420 | 5/1980 | Likholai et al. | 299/2 |
| 4,283,088 | 8/1981 | Tabakov et al. | 299/2 |
| 4,296,969 | 10/1981 | Willman | 299/2 |
| 4,381,124 | 4/1983 | Verty et al. | 299/2 |

*Primary Examiner*—Ernest R. Purser

*Attorney, Agent, or Firm*—Robert H. Sproule; George L. Rushton

[57] ABSTRACT

A process for in situ recovery of a tar sand deposit located beneath the earth's surface. A number of boreholes are drilled laterally from subsurface tunnels into the lower portion of the tar sands formation. Initially as a displacing means such as steam is injected into the boreholes, the tar sands become viscous and gravity flow into the bottom of the boreholes. Continuing to apply steam removes the tar sand deposits located in interstitial crevices between the boreholes thereby allowing the steam to flow laterally through these interstitial crevices to nearby boreholes. The steam rises toward the upper portion of the resource formation to create a horizontal heated plane of steam to further remove tar sand deposits located therein.

31 Claims, 10 Drawing Figures

HORIZONTAL HEATED PLANE PROCESS

BACKGROUND OF THE INVENTION

This invention relates to in situ recovery of a resource from a deep subsurface formation. More specifically, this invention provides a method for recovering a resource from a deep subsurface formation by creating a horizontal plane of heated displacing means between boreholes in the lower portion of the subsurface formation, resulting in an extensive surface area for heat transfer into the upper portion of the formation.

There are many methods for recovery of a resource such as tar sands from beneath the earth's surface. Where there is little overburden, surface mining techniques have been employed. However when the overburden is thick or the ratio of overburden to tar sands thickness is high, then surface mining is not economical. Many in situ recovery methods have been proposed. For the deeper buried tar sands reservoirs, wells are drilled from the earth's surface down into the tar sand formation. A broad range of methods has been devised to establish both a communication path through the heavy, highly viscous bitumen-filled sand and an efficient method to recover the bitumen from the sand. These methods, such as fracturing, steam injection, fire flooding, solvent flooding, gas injection and various combinations of these operational steps, involve the introduction of steam, gas or other displacing fluid by means of vertical holes drilled into or in proximity with the resource formation. These processes generally involve the heating of the resource formation to reduce the viscosity of the resource, thereby allowing removal of the resource from the formation by hydraulic means or gravity flow. U.S. Pat. No. 4,160,481 uses a plurality of boreholes radially extending from a central shaft to inject steam into the resource formation. The steam is injected into some of the boreholes to drive the resource into the remaining borehouse where it is collected.

My invention, on the other hand, utilizes a horizontal heated plane of displacing means to greatly increase the exposure of the formation to the displacing means and thereby promote rapid and efficient transfer of heat to the resource. The horizontal heated plane is created by injecting heated displacing means into a plurality of boreholes within the resource formation. Unlike U.S. Pat. No. 4,160,481, heated displacing means is continuously added to the boreholes such that the resource in nearby boreholes is removed, thereby allowing the displacing means to laterally flow into nearby boreholes through the interstitial crevices between the boreholes vacated by the resource. The lateral flow of heated displacing means between the boreholes creates the most extensive surface area for heat transfer to the upper portion of the resource formation. The heated displacing means, such as steam, rises, condenses, and then drains, forming a local circulation cell. In addition, less heat is lost to the overburden since non-productive shales and sands above the tar sand will receive less heat from the process. When the heated zone reaches the height of the overburden, the process is nearly complete, and steam injection ceases in these boreholes thereby reducing the amount of heat transferred to the overburden.

In my invention, displacing means can be injected and removed from the boreholes simultaneously, thereby allowing the displacing means to be injected into all the boreholes at the same time if desired. By injecting displacing means into as many boreholes as possible, a larger horizontal heated plane is created, resulting in greater and more efficient heat transfer to the resource. Therefore, what is needed and what has been invented by us is a method for in situ recovery of a resource from a subsurface formation without the foregoing deficiencies associated with the prior art methods.

SUMMARY OF THE INVENTION

It is an object of this invention to provide a process for in situ recovery of a resource by heating the formation to increase the permeability of the resource.

It is another object of this invention to create a horizontal plane of heated displacing means across the lower portion of the subsurface formation in order to more efficiently heat the remainder of the subsurface formation.

It is yet another object of this invention to continuously inject heated displacing means into the boreholes while simultaneously removing resource production and displacing means from the boreholes.

These, together with various ancillary objects and features which will become apparent as the following description proceeds.

The present invention accomplishes its desired objects by broadly providing a method for in situ recovery of a subterranean resource. The invention comprises a horizontal heated plane process for in situ recovery of a resource from a subsurface formation. The process requires that the relative permeability of the resource be increased by the addition of heat thereto. The process comprises forming a plurality of lateral boreholes in the lower portion of the resource formation, injecting a displacing means into the boreholes in order to permeate the resource therein, causing the resource to become less viscous and to gravity flow (flow under the force of gravity) into the lower portion of the boreholes, and then continuing to inject displacing means into the boreholes such that the resource located in interstitial crevices between the boreholes is removed, allowing the displacing fluid to flow laterally through the interstitial crevices vacated by the resource into the adjacent boreholes. The heated displacing means rises towards the upper portion of the resource formation to create a horizontal heated plane of displacing means to remove the resource therein.

DETAILED DESCRIPTION OF THE INVENTION

Figure 1:
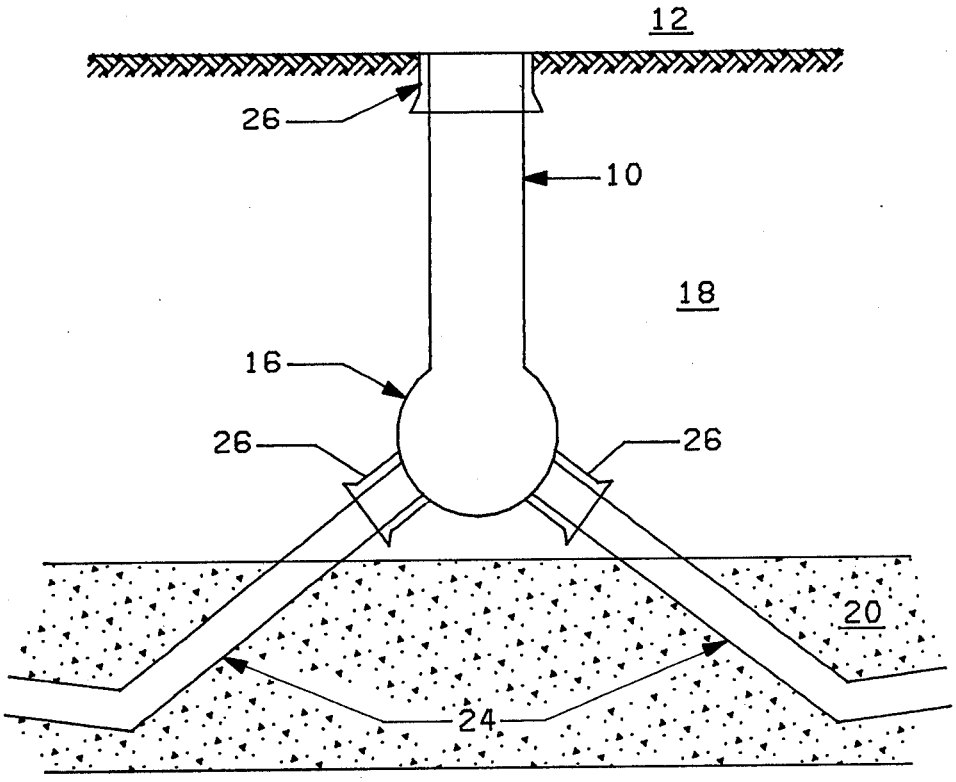
FIG. 1 is an elevation view of a shaft extending to a location below the resource formation, a plurality of boreholes laterally extend from the access tunnel into the overlaying competent formation.
Figure 2:
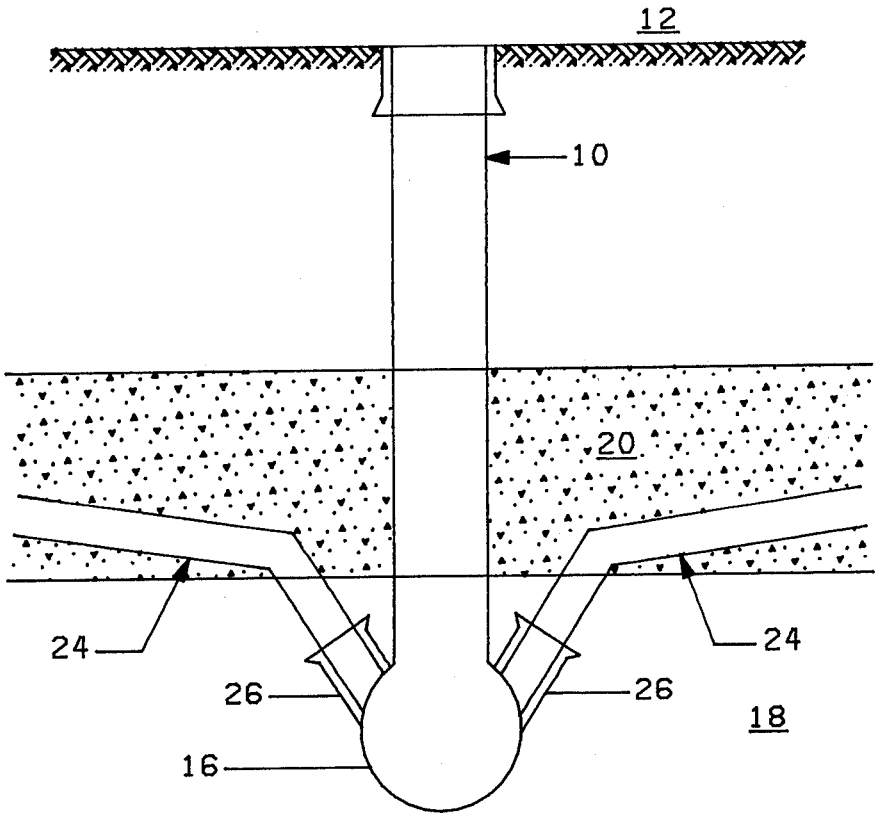
FIG. 2 is an elevation view of a shaft extending to a location above the resource formation, a plurality of boreholes laterally extend from the access tunnel into the underlaying competent formation.
Figure 3:
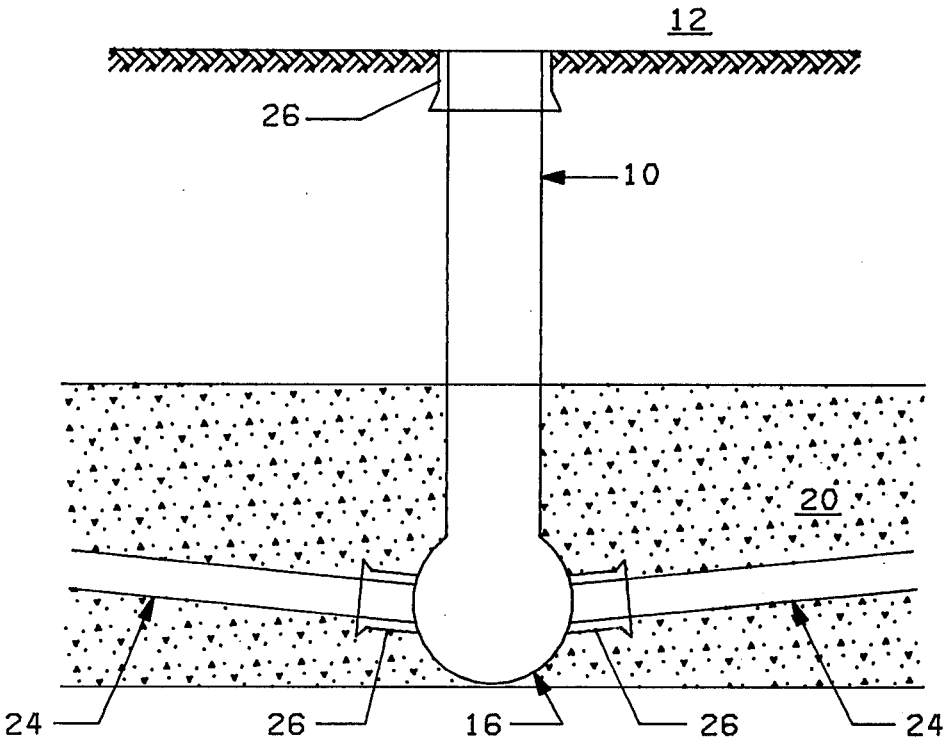
FIG. 3 is an elevation view of a shaft extending into an area in proximity to the base of the resource formation, a plurality of boreholes laterally extend from the access tunnel into the resource formation.

Referring in detail now to the drawings wherein like or similar parts of the invention are identified by like reference numerals, FIG. 1 defines a shaft generally illustrated as 10 for access from the earth's surface 12 into the earth's subsurface. The diameter of shaft 10 must be sufficiently large to permit working personnel, drilling and support equipment to pass through shaft 10. Shaft 10 may be substantially vertical to earth's surface 12 as depicted in FIG. 1, or it may intersect the earth's surface 12 at any angle which will permit movement of personnel and equipment therethrough. Interconnecting with shaft 10 is the main access tunnel generally illustrated as 16. Main access tunnel 16 is drilled into a competent formation 18 located within the earth's subsurface, competent formation 18 having sufficient strength to support internal tunnelling therethrough. The competent formation 18 may be above the subsurface formation 20 containing the resource as depicted in FIG. 1, the competent formation 18 may lie below the resource subsurface formation 20 as depicted in FIG. 2, or the resource formation 20 may constitute the competent formation 18 as depicted in FIG. 3. Referring now to FIG. 1, wherein competent formation 18 lies above the resource formation 20, main access tunnel 16 is excavated in the competent formation 18 above the resource formation 20. A plurality of lateral boreholes, generally illustrated as 24, are drilled in a downward direction to a location in proximity to the bottom of resource formation 20 and then continued at a slight incline along the base of resource formation 20. Boreholes 24 are drilled to extend from opposite sides of main access tunnel 16 from about 30 feet to about 100 feet apart into the lower portion of resource formation 20. Preferably, boreholes 24 are drilled generally parallel to one another to provide a uniform distance between boreholes 24 for the displacing means to travel; however, where the density of the resource formation 20 varies, it may be desirable to vary the distance between boreholes 20 to compensate for the increased or decreased travel time of the displacing means between boreholes 20.

Boreholes 24 are started at 30° to 40° below the horizontal and drilled into resource formation 20 continuing until in proximity to the base of resource formation 20. Conductor pipe 26 is set and cemented into place in the competent formation to provide stability about the entrance to borehole 20. With pressure control, drilling equipment and a pressurized mud system, boreholes 24 are then drilled to an approximate incline of about 5° above the horizontal and continued an additional 750 to 2000 feet.

When the competent formation 18 is below the resource formation 20, as depicted in FIG. 2, boreholes 24 are drilled outwardly from main access tunnel 16 30°–40° above the horizontal and continued until in proximity to the base of resource formation 20. The boreholes 24 are then continued for an additional 750 to 2000 feet at an incline of approximately 5° above the horizontal.

When the competent formation 18 and the subsurface resource formation 20 are the same, as depicted in FIG. 3, main access tunnel 16 is excavated near the base of resource formation 20. Boreholes 24 are drilled outwardly from main access tunnel 16 at approximately 750 to 2000 feet at a slight incline of approximately 5° above the horizontal.

After forming boreholes 24, a displacing means is injected into boreholes 24 in order to permeate the resource heated within resource formation 20 thereby causing the resource to become less viscous and to gravity flow with the displacing means to the bottom of borehole 24. The resource may consist of any formation deposit having a low initial relative permeability to a displacing means if introduction of heat will act upon the resource in such a manner so as to increase the relative permeability of the resource. The displacing means may consist of hot water or hot solvents, such as kerosene, naptha, or a combination of these solvents and water. Steam is generally the most desirable displacing means because of its high heat content and high mobility. In the establishment of the horizontal heated plane, hot water, hot solvents or combinations thereof mixed with surfactants may be more desirable in order to insure the horizontal plane of communication fully develops before appreciable vertical channeling takes place. When full displacement of the horizontal heated plane results, improved sweep efficiency may be achieved by the introduction of inert gases, flue gas, air with steam, or any combination thereof with steam. At this later stage, it may be desirable to promote vertical permeability through the use of these gases to create vertical channels through the laminations of clay and shale to the upper portion of the resource formation 20.

Figure 4:
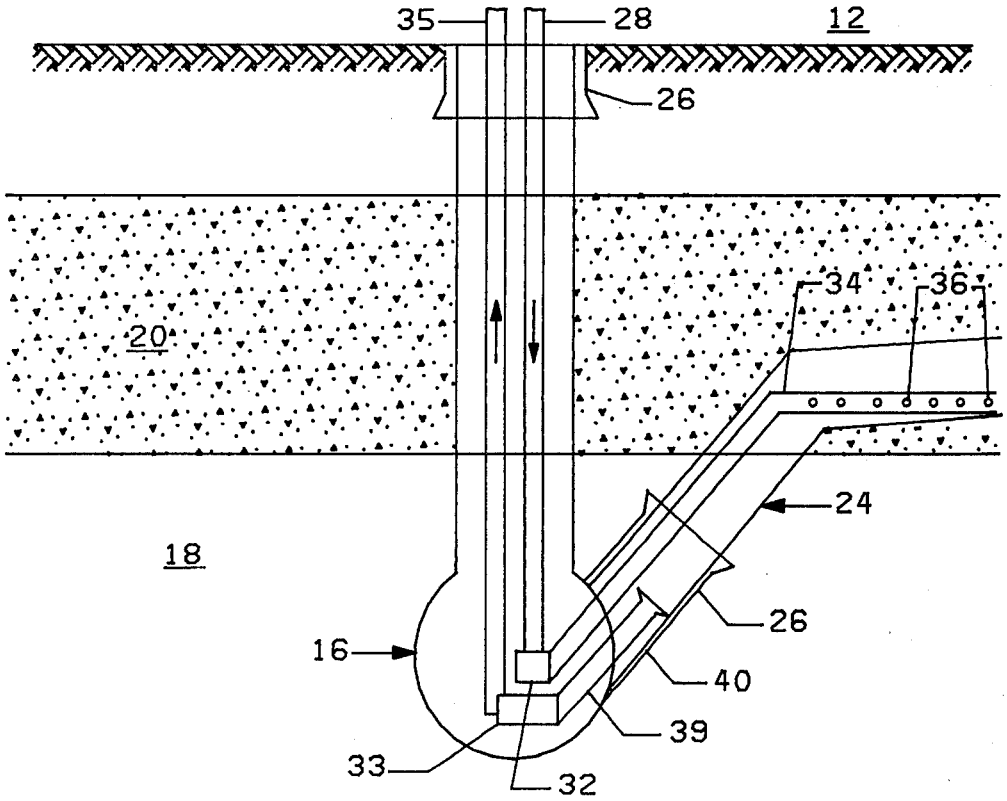
FIG. 4 is a elevation view of the injection and evacuation piping extending through the shaft, production tunnels and boreholes.

Steam is introduced into boreholes 24 through a steam piping system depicited in FIG. 4. Steam generated at the surface flows down shaft riser pipes 28 to main access tunnel 16 and to a valve manifold 32 at the entrance to boreholes 24. The length of boreholes 24 are equipped with injection piping 34 through which steam may be distributed throughout borehole 24. Circumferential openings 36 along injection piping 34 distribute the steam over that portion of the borehole 24 extending within the resource formation 20 in order to obtain more uniform heating of the resource. Boreholes 24 also include a production gathering system consisting of an evacuation pipe means 39 the opening of which is located at the borehole opening 40 in order to collect the resource production as the production gravity flows down the inclined borehole 24 to the borehole opening 40. Evacuation pumps 33 collect and pump the production/water mixture through riser pipes 35 to the earth's surface 12 for further processing. Surface facilities (not shown in drawings) are required for steam production, electrical power generation, resource separation, water treatment and site services.

Figure 5:
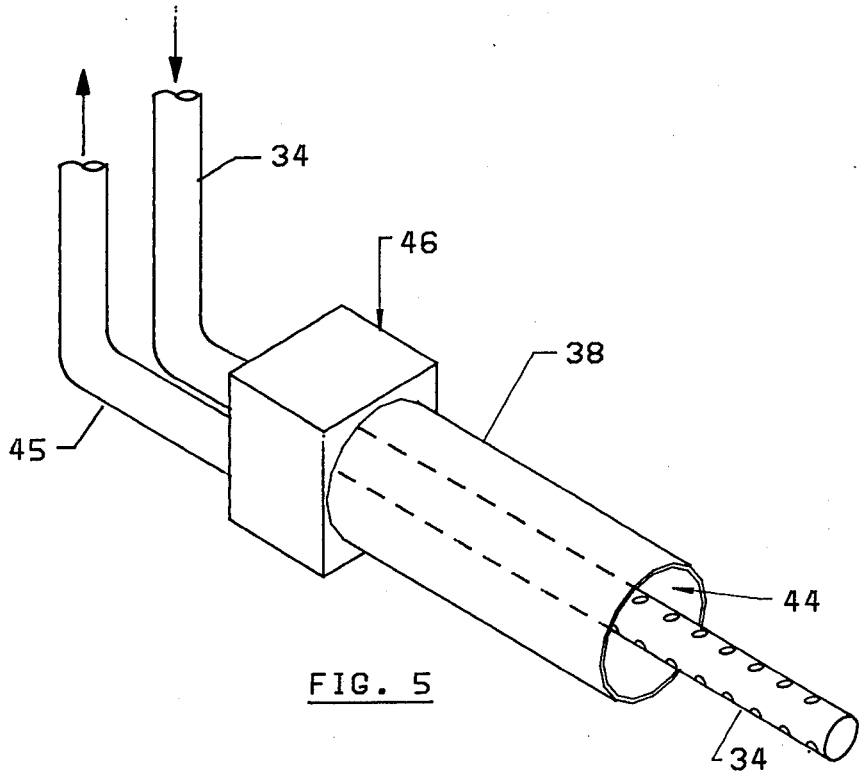
FIG. 5 is a perspective view illustrating the annular area and assorted piping for collection and removal of resource production and displacing fluid in a continuous controlled circulation system.

In a alternate embodiment, depicited in FIG. 5, an injection piping 34 having a smaller diameter than evacuation piping 38, is located inside evacuation piping 38 such that their respective longitudinal axes are generally aligned. An annular area, generally illustrated as 44, comprising the area between the outer wall of injection pipe 34 and the inner wall of evacuation pipe 38 is used for the collection and removal of resource production, steam condensate and formation water. A manifold valve means 46 allows regulated withdrawal of these liquids through conduit 45. Displacing fluid is continuously injected into borehole 24 through injection pipe 34 while simultaneously removing resource production and displacing fluid from the lower portion of the borehole 24 through the annular area 44 of evacuation pipe 38 thereby resulting in a continuous controlled circulation of injection and evacuation.

Figure 6:
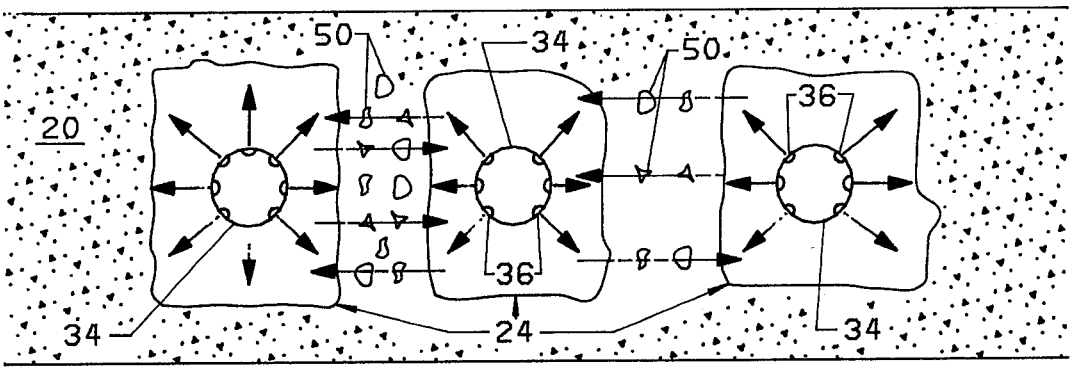
FIG. 6 is a cross-section view of the boreholes, illustrating the flow of displacing fluid between adjacent boreholes to create a horizontal heated plane of mobility.

Referring now to FIG. 6, after heated displacing fluid has been injected into boreholes 24, heating continues until considerable bitumen has been heated and removed from the formation rock 20 located between nearby boreholes 24. The viscous bitumen entrapped within the formation rock 20 is heated to reduce viscosity. The reduced viscosity bitumen then gravity flows to the bottom of boreholes 24 leaving small openings or interstitial crevices 50 in the formation previously occupied by the bitumen. A low steam pressure differential removes this remaining bitumen between nearby boreholes 24, allowing the steam to flow through the vacated interstitial crevices 50 to the other boreholes 24. The flow of displacing means between the boreholes 24 forms the horizontal heated plane of mobility. The horizontal heated plane constitutes a horizontal plane of heated displacing means which acts upwardly against resource formation 20 to blanket the under surface of resource formation 20. The blanketing effect, utilizing the natural tendency of heated displacing means to rise, thereby increases the area of coverage of the displacing means over the surface area of the resource formation 20. Displacing means is continuously injected into boreholes 24 until the remaining resource in the upper portion of the resource formation 20 has been dislodged from the formation and gravity drained to the bottom of borehole 24 for subsequent removal.

In order to aid heating of the resource, metal piping or liners 42 may be utilized in boreholes 24 as electrodes after proper insulation and connection to an AC power source (not shown in drawings). The flow of electrical current between metal liners 42 heats the water contained in the tar sand formation, thereby decreasing the amount of steam necessary to heat the bitumen in resource formation 20.

As steam injection proceeds resulting in the horizontal heated plane between boreholes 24, it is advantageous to stop introducing steam into certain of those boreholes 24 receiving steam indirectly through nearby boreholes 24. The reduction in the number of boreholes 24 receiving direct steam injection not only reduces the maintenance required for the steam injection and evacuation equipment, but it also reduces the amount of steam input, resulting in a more slowly rising arch of steam in resource formation 20. In order to increase thermal efficiency and to prevent heat loss, the terminated boreholes 24 may be sealed off at borehole opening 40 by a cement plug or other similar device.

Figure 7:
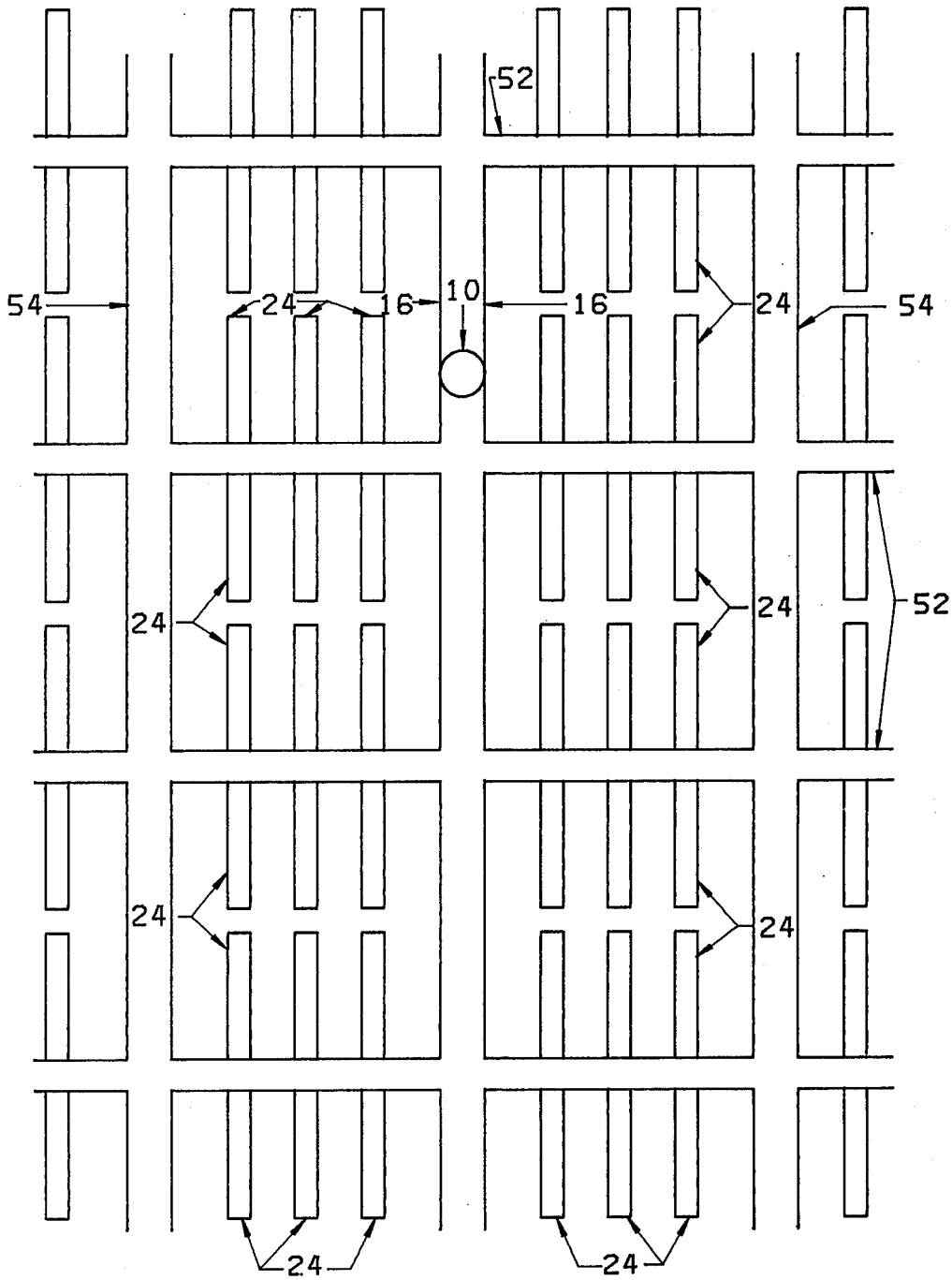
FIG. 7 is an overhead view of the development illustrating the lateral boreholes, production tunnels, and main tunnels.

In order to expand the tunnel network along one directional axis, a plurality of production tunnels, generally illustrated as 52 and depicted in FIG. 7, may be excavated to interconnect with the main access tunnel 16. The production tunnels 52 are formed such that the longitudinal axes of the production tunnels 52 are generally perpendicular to the longitudinal axis of main access tunnel 16. The distance between the longitudinal axis of adjacent production tunnels 52 is from about 1500 to about 4000 feet. The production tunnels 52 are of sufficient diameter to allow movement of drilling personnel and equipment through them. Boreholes 24 are then drilled in a lateral direction from production tunnels 52 extending into the lower portion of the resource formation 20 as previously described.

Referring still to FIG. 7, to further expand the tunnel network along another directional axis, main tunnels generally illustrated as 54 may be drilled to interconnect with the production tunnels 52 such that the longitudinal axes of the main tunnels 54 are generally parallel to the longitudinal axes of the main access tunnel 16. The main tunnels 54 are of sufficient diameter to permit movement of personnel and equipment through them. Generally the distance between the respective longitudinal axes of the main tunnels 54 is from about 3000 feet to about 5000 feet. The distance from the main access tunnel 16 to the first set of main tunnels 54 located on either side of the main access tunnel 16 is from about 1500 feet to about 2500 feet. Generally these main tunnels 54 will be repeated in parallel rows at intervals of about 3000 to 5000 feet along one directional axis to provide expansion of the tunnel network as the project area grows. Production tunnels 52 are interconnected with the main tunnels 54, the longitudinal axes of the production tunnels 52 being generally perpendicular to the longitudinal axes of the main tunnels 54. Boreholes 24 extend laterally from the production tunnels 52 into the lower portion of the formation 20.

Figure 8:
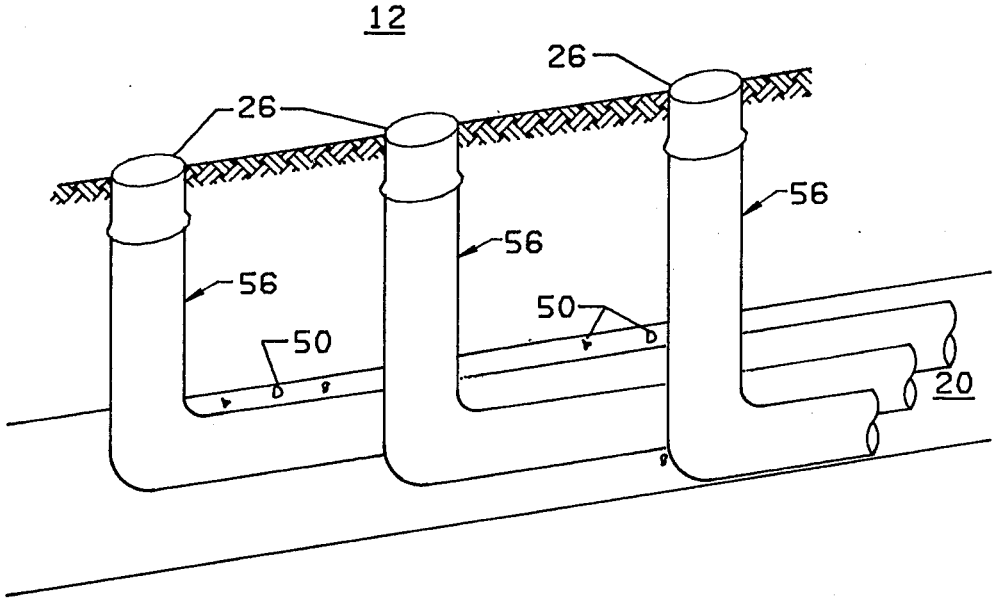
FIG. 8 is an elevation view of boreholes deviated to the horizontal in the resource formation.

In another embodiment of the invention as depicted in FIG. 8, a plurality of deviated boreholes generally illustrated as 56 are drilled from the earth's surface 12 into the lower portion of the resource formation 20. The boreholes 56 may start out at the earth's surface 12 nearly vertical but are then deviated as drilling proceeds into the earth's subsurface, to positions substantially aligned with the subsurface formation when near the base. Additional boreholes 56 are drilled generally parallel to and on the same horizontal plane as the initially drilled borehole 56 such that the longitudinal axes of the boreholes are from about 50 to about 200 feet apart. Heated displacing means such as steam is injected into boreholes 56. The displacing means reduces the viscosity of the resource entrapped within resource formation 20 causing the resource to gravity flow to the bottom of boreholes 56. As injection of displacing means continues, a horizontal heated plane of mobility is created between the boreholes 56 caused by the flow of displacing means through the vacated interstitial crevices 50. The displacing means and resource production is collected in a sump and pumped to the surface 12 by artificial lift means such as a surface tubing pump.

Figure 9:
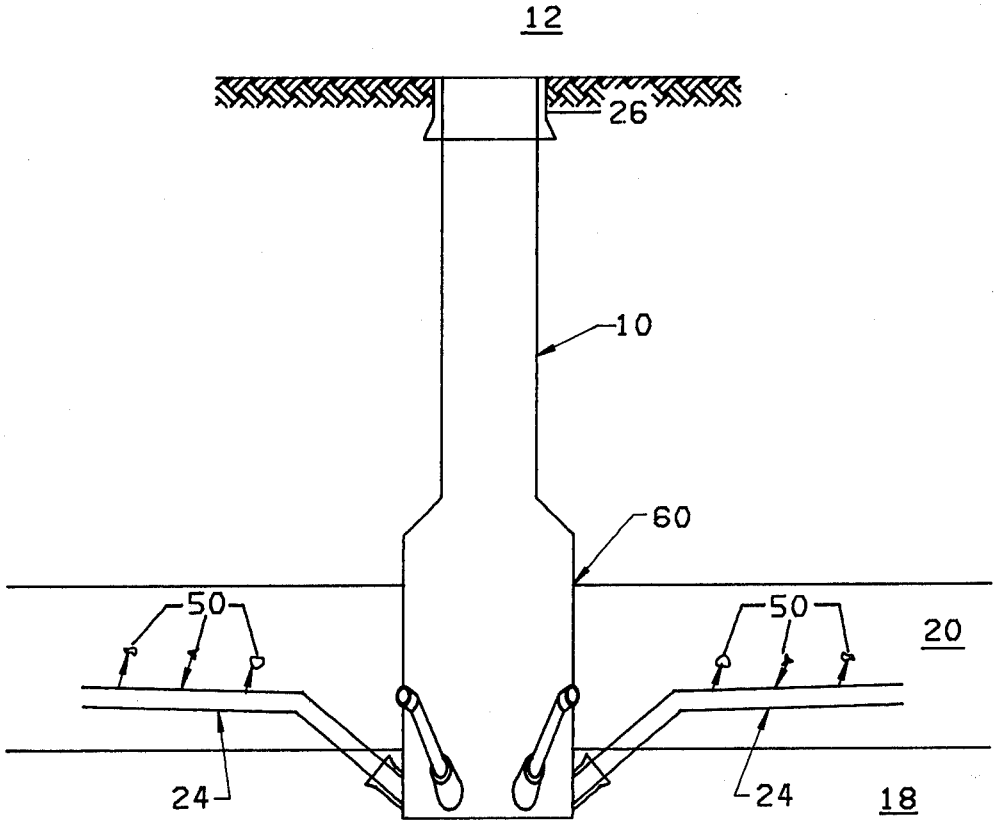
FIG. 9 is an elevation view of a shaft terminating in an enlarged chamber which includes a plurality of radial boreholes extending from the chamber into the resource formation.

Another embodiment of the invention depicted in FIG. 9 includes a plurality of boreholes 24 radially extending from a chamber, generally illustrated as 60, like spokes of a wheel into the resource formation 20. A shaft 10 extends from the earth's surface 12 into the competent formation 18. The chamber 60 is a drilling and producing borehole constructed at the bottom of shaft 10. The boreholes 24 are drilled from chamber 60 into the lower portion of the resource formation 20 and extend approximately 2000 feet into resource formation 20 at a slight incline. Displacing means is then injected into the boreholes. As the resource is heated and becomes less viscous, it gravity flows to the bottom of radial boreholes 24. The heated displacing means forms a horizontal heated plane of mobility between the radial boreholes 24 when the displacing means flows between the boreholes 24 through the vacated interstitial crevices 50. Steam injected into these radial boreholes 24 creates a circular or square horizontal heated plane depending upon the particular pattern created by the radial boreholes 24.

Figure 10:
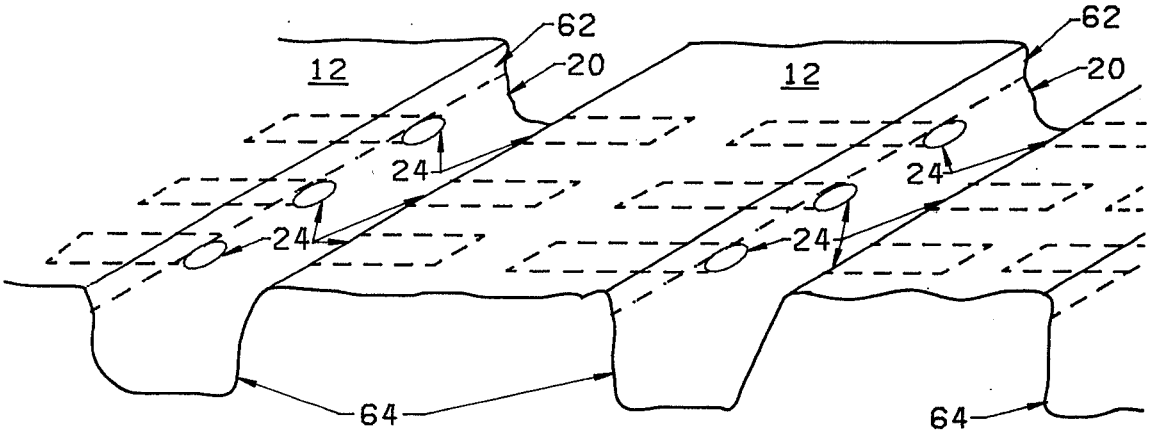
FIG. 10 is a cross-section of a series of trenches excavated in the resource formation utilizing a plurality of lateral boreholes extending into the resource formation.

Another embodiment of the invention as depicted in FIG. 10, comprises a plurality of trenches, generally illustrated as 64, dug into the earth's surface 12 through a thin overburden generally illustrated as 62. From trenches 64, a plurality of inclined lateral boreholes 24 are drilled approximately 2000 feet into the resource formation 20 at opposite sides of the trench 64. Preferably, boreholes 24 are drilled generally parallel to one another from about 30 to 100 feet apart. Heated displacing means is injected into the formation 20 through boreholes 24. After sufficient heating of the resource, a horizontal heated plane of mobility results between the boreholes 24.

While the present invention has been described herein with reference to particular embodiments thereof, a latitude of modification, various changes and substitutions are intended in the foregoing disclosure, and in some instances some features of the invention will be employed without a corresponding use of other features without departing from the scope of the invention.

We claim:

1. A horizontal heated plane process for in situ recovery of a resource from a subsurface resource formation comprising:

(a) forming a plurality of lateral bore holes in the lower portion of the resource formation;

(b) injecting a heated displacing means into said bore holes to permeate the resource therein causing the resource to become less viscous and gravity flow into the lower portion of said bore holes;

(c) continuing to inject heated displacing means into said bore holes such that the resource located in interstitial crevices between said bore holes is removed, allowing the heated displacing means to flow laterally through the interstitial crevices vacated by the resource and into adjacent bore holes, and (d) allowing the heated displacing means to rise toward the upper portion of the resource formation to create a horizontal heated plane of communication, thus improving the removal of the resource therein.

2. The horizontal heated plane process for in situ recovery of a resource as recited in claim 1 additionally comprising discontinuing the injection of heated displacing means into at least one bore hole receiving heated displacing means through the vacated interstitial crevices.

3. The horizontal heated plane process for in situ recovery of a resource as recited in claim 2 additionally comprising closing off the entrance to at least one bore hole receiving heated displacing means from an adjacent bore hole.

4. The horizontal heated plane process for in situ recovery of a resource as recited in claim 3 additionally comprising:

(a) injecting heated displacing means into said boreholes through an injection pipe inside said bore holes, said injection pipe having circumferential outlet holes along the longitudinal axis thereof; and (b) evacuating resource production and displacing means from the lower portion of said bore holes through an evacuation pipe, the larger diameter evacuation pipe positioned around and outside of the smaller diameter injection pipe such that the longitudinal axes of the evacuation pipe means and the injection pipe means are aligned to form an annular area between the outer wall of the injection pipe and the inner wall of the evacuation pipe for the collection and removal of the resource production and displacing means.

5. The horizontal heated plane process for in situ recovery of a resource as recited in claim 4 additionally comprising injecting heated displacing means continuously through said injection pipe while simultaneously removing resource production and displacing means from the lower portion of said bore holes through the annular area of said evacuation pipe.

6. The horizontal heated plane process for in situ recovery of a resource as recited in claim 1 wherein a competent formation lies generally below said subsurface resource formation.

7. The horizontal heated plane process for in situ recovery of a resource as recited in claim 1 wherein a competent formation lies generally above said subsurface resource formation.

8. The horizontal heated plane process for in situ recovery of a resource as recited in claim 1 wherein a competent formation and the subsurface resource formation are the same.

9. The horizontal heated plane process for in situ recovery of a resource as recited in claim 1 wherein:

(a) the distance between the longitudinal axes of said bore holes is from about 30 feet to about 100 feet; and (b) the length of each bore hole is from about 750 feet to about 1500 feet.

10. A horizontal heated plane process for in situ recovery of a resource on a subsurface resource formation comprising:

(a) forming at least one access means from the earth's surface into the earth's subsurface, said access means sized to permit movement of personnel and equipment therethrough;

(b) forming one lateral main access tunnel in a competent formation such that said main tunnel is interconnected with said access means;

(c) forming a plurality of bore holes laterally extending from said main tunnel into the lower portion of the resource formation;

(d) injecting a heated displacing means into said bore holes to permeate the resource therein, causing the resource to become less viscous and gravity flow into the lower portion of said bore holes;

(e) continuing to inject heated displacing means into said bore holes such that the resource located in interstitial crevices between the bore holes is removed, allowing the heated displacing means to flow laterally through the interstitial crevices vacated by the resource and into adjacent bore holes, and (f) allowing the heated displacing means to rise toward the upper portion of the resource formation to create a horizontal heated plane of communication, thus allowing heated displacing means to remove the resource therein.

11. A horizontal heated plane process for in situ recovery of a resource from a subsurface resource formation comprising:

(a) forming at least one access means from the earth's surface into the earth's subsurface, said access means sized to permit movement of personnel and equipment therethrough;

(b) forming one lateral main access tunnel in a competent formation such that said main tunnel is interconnected with said access means;

(c) forming a plurality of lateral production tunnels interconnected with said main access tunnel;

(d) forming a plurality of bore holes laterally extending from each said production tunnel into the lower portion of the resource formation;

(e) injecting a heated displacing means into said bore holes to permeate the resource therein, causing the resource to become less viscous and gravity flow into the lower portion of said bore holes;

(f) continuing to inject heated displacing means into said bore holes such that the resource located in interstitial crevices between the bore holes is removed, allowing the heated displacing means to flow laterally through the interstitial crevices vacated by the resource and into adjacent bore holes, and (g) allowing the heated displacing means to rise toward the upper portion of the resource formation to create a horizontal heated plane of communication and to remove the resource therein.

12. The horizontal heated plane process for in situ recovery of a resource as recited in claim 11 additionally comprising discontinuing the injection of heated displacing means from the production tunnels into at least one bore hole receiving heated displacing means through the vacated interstitial crevices.

13. The horizontal heated plane process for in situ recovery of a resource as recited in claim 12 additionally comprising closing off from the production tunnels at least one bore hole receiving heated displacing means through the vacated interstitial crevices.

14. The horizontal heated plane process for in situ recovery of a resource as recited in claim 11 additionally comprising inclining the bore holes above the horizontal, such that the longitudinal axes of the bore holes ascend from the junction where the bore holes interconnect with the production tunnels to allow the viscous resource in the lower portion of said bore holes to gravity flow into said production tunnels.

15. The horizontal heated plane process for in situ recovery of a resource as recited in claim 14 additionally comprising forming additional lateral main tunnels interconnecting with said production tunnels, each main tunnel positioned generally parallel to said main access tunnel.

16. The horizontal heated plane process for in situ recovery of a resource as recited in claim 15 wherein the distance between the longitudinal axes of said main tunnels is from about 3000 feet to about 5000 feet.

17. The horizontal heated plane process for in situ recovery of a resource as recited in claim 11 additionally comprising:

(a) injecting the heated displacing means into said boreholes through an injection pipe inside said bore holes, said injection pipe means having circumferential outlet holes along the longitudinal axis thereof; and (b) evacuating resource production and displacing means from the lower portion of said bore holes through an evacuation pipe, the larger diameter evacuation pipe positioned around and outside of the smaller diameter injection pipe such that the longitudinal axes of the evacuation pipe and the injection pipe are aligned to form an annular area between the outer walls of the injection pipe and the inner wall of the evacuation pipe for the collection and removal of said resource production and and displacing means.

18. The horizontal heated plane process for in situ recovery of a resource as recited in claim 17 additionally comprising injecting heated displacing means continuously through said injection pipe while simultaneously removing resource production and displacing means from the lower portion of said bore holes through the annular area of said evacuation pipe.

19. The horizontal heated plane process for in situ recovery of a resource as recited in claim 10 wherein the competent formation lies generally below the subsurface formation.

20. The horizontal heated plane process for in situ recovery of a resource as recited in claim 10 wherein the competent formation lies generally above the subsurface formation.

21. The horizontal heated plane process for in situ recovery of a resource as recited in claim 10 wherein the competent formation and the subsurface resource formation are the same.

22. The horizontal heated plane process for in situ recovery of a resource as recited in claim 10 wherein:

(a) the distance between the longitudinal axes of said production tunnels is from about 1500 feet to about 4000 feet;

(b) the distance between the longitudinal axes of said bore holes is from about 30 feet to about 100 feet; and (c) the length of said bore holes is from about 750 feet to about 1500 feet.

23. A horizontal heated plane process for in situ recovery of a resource from a subsurface resource formation comprising:

(a) forming a plurality of bore holes from the earth's surface into the earth's subsurface;

(b) deviating said bore holes such that said bore holes are generally aligned with and in proximity to the base of the subsurface formation;

(c) injecting the heated displacing means into said bore holes to permeate the resource therein, causing the resource to become less viscous and gravity flow into a lower portion of said bore holes;

(d) continuing to inject the heated displacing means into said bore holes such that the resource located in interstitial crevices between the bore holes is removed, allowing the heated displacing means to flow through the interstitial crevices vacated by the resource and into adjacent bore holes, and (e) allowing the heated displacing means to rise toward the upper portion of the resource formation to create a horizontal heated plane of communication and to remove the resource therein.

24. A horizontal heated plane process for in situ recovery of a resource from a subsurface formation, comprising:

(a) forming at least one access means from the earth's surface into the earth's subsurface, said access means terminating in proximity to the subsurface formation, said access means sized to permit movement of personnel and equipment therethrough;

(b) forming a plurality of bore holes extending radially outward from said access means into the subsurface formation;

(c) injecting a heated displacing means into said bore holes in order to permeate the resource therein, causing the resource to become less viscous and gravity flow into the lower portion of said bore holes;

(d) continuing to inject the heated displacing means into said bore holes such that the resource located in interstitial crevices between the bore holes is removed, allowing the heated displacing means to flow through interstitial crevices vacated by the resource and into adjacent bore holes, and (e) allowing the heated displacing means to rise toward the upper portion of the resource formation to create a horizontal heated plane of communication and to remove the resource therein.

25. The horizontal heated plane process for in situ recovery of a resource as recited in claim 23 or 24 additionally comprising discontinuing the injection of heated displacing means into at least one bore hole receiving heated displacing means through the vacated interstitial crevices.

26. The horizontal heated plane process for in situ recovery of a resources as recited in claim 25 additionally comprising closing off from the access means at least one bore hole receiving heated displacing means through the vacated interstitial crevices.

27. The horizontal headed plane process for in situ recovery of a resource as recited in claim 23 wherein the distance between the longitudinal axes of the said bore holes is from about 30 feet to about 100 feet.

28. A horizontal heated plane process for in situ recovery of a resource from a shallow subsurface resource formation comprising:

(a) forming a plurality of trenches into the shallow subsurface formation, said trenches sized to permit passage of personnel and equipment therethrough;

(b) extending laterally a plurality of bore holes outwardly from said trenches into the subsurface resource formation;

(c) injecting the heated displacing means into said bore holes in order to permeate the resource therein, causing said resource to become less viscous and gravity flow into the lower portion of said bore holes;

(d) continuing to inject the heated displacing means into said bore holes such that the resource located in interstitial crevices between the bore holes is removed, allowing the heated displacing fluid to flow through the interstitial crevices vacated by the resource and into adjacent bore holes, and (e) allowing the heated displacing means to rise toward the upper portion of the resource formation to create a horizontal heated plane of communication and to remove the resource therein.

29. The horizontal heated plane process for in situ recovery of a resource as recited in claim 28 additionally comprising discontinuing the injection of heated displacing means into at least one bore hole receiving heated displacing means through the vacated interstitial crevices.

30. The horizontal heated plane process for in situ recovery of a resource as recited in claim 29 additionally comprising closing off from the trenches at least one bore hole receiving heated displacing means through the vacated interstitial crevices.

31. The horizontal heated plane process for in situ recovery of a resource as recited in claim 30 wherein the distance between the longitudinal axes of said boreholes is from about 30 feet to about 100 feet.

* * * * *